United States Patent [19]

Dahowski et al.

[11] Patent Number: 4,829,732

[45] Date of Patent: May 16, 1989

[54] ANCHOR SOCKET JIG ASSEMBLY

[75] Inventors: Donald E. Dahowski, York; Scott E. Crandall, Dover, both of Pa.

[73] Assignee: Quaker Plastic Corporation, Mountville, Pa.

[21] Appl. No.: 848,525

[22] Filed: Apr. 7, 1986

[51] Int. Cl.[4] ..... E02D 27/42; E06C 9/02

[52] U.S. Cl. ..... 52/298; 52/704; 52/709; 52/710; 248/519; 182/93; 182/87

[58] Field of Search ..... 52/298, 293, 710, 709, 52/698, 704; 182/93, 87; 248/519, 523

[56] References Cited

U.S. PATENT DOCUMENTS

| | | | |
|---|---|---|---|
| 909,769 | 1/1909 | Downing et al. | 52/709 |
| 1,281,699 | 10/1918 | Swan | 52/709 |
| 1,586,833 | 6/1926 | Nicholson | 52/709 |
| 1,939,968 | 12/1933 | Frei, Jr. | 52/298 |
| 2,966,708 | 1/1961 | Freeman, Jr. | 52/293 |
| 3,055,460 | 9/1962 | Maroney | 52/293 |
| 3,065,820 | 11/1962 | Prizler et al. | 182/93 |
| 3,894,375 | 7/1975 | Lindberg et al. | 52/298 |
| 4,008,550 | 2/1977 | Kaufman | 52/298 |
| 4,059,934 | 11/1977 | Hayamizu | 52/298 |

FOREIGN PATENT DOCUMENTS

| | | | |
|---|---|---|---|
| 2604850 | 8/1977 | Fed. Rep. of Germany | 52/698 |
| 3232105 | 3/1984 | Fed. Rep. of Germany | 52/698 |
| 504475 | 7/1920 | France | 52/298 |

OTHER PUBLICATIONS

Trade Brochure, Fox Pool Corporation, York, PA, Copyright 1985, p. 23.

*Primary Examiner*—William F. Pate, III
*Assistant Examiner*—Michael Safavi
*Attorney, Agent, or Firm*—Arthur J. Plantamura

[57] ABSTRACT

An improved anchor socket and jig assembly for holding implements in concrete is provided which facilitates assembly of the socket element on the base member of the jig assembly and which affords substantially expanded adaptability of the jig for varied size implements and avoids the need for bolts or other extraneous means to secure the socket member to the rail member.

The improved jig assembly comprises a longitudinal base member preferably of substantially rigid plastic composition which is provided with locator openings which fit one of the feet of the socket member and, cooperating therewith, a mating turn slot. Both the openings and the turn slots are formed to accommodate the feet of the socket member. The assembly of the socket in the base member in a secure position is readily effected by positioning the socket member between the rails of the base member and locking the two by a manual quarter turn rotation of the socket member in the base member. No tools or other assembly operation of any kind is needed. The socket member is formed so that feet at the opposite sides and at the base of the socket are spaced so that the distance to the extremities is greater than the distance between the base member rails which secure the socket feet.

10 Claims, 2 Drawing Sheets

FIG. 1
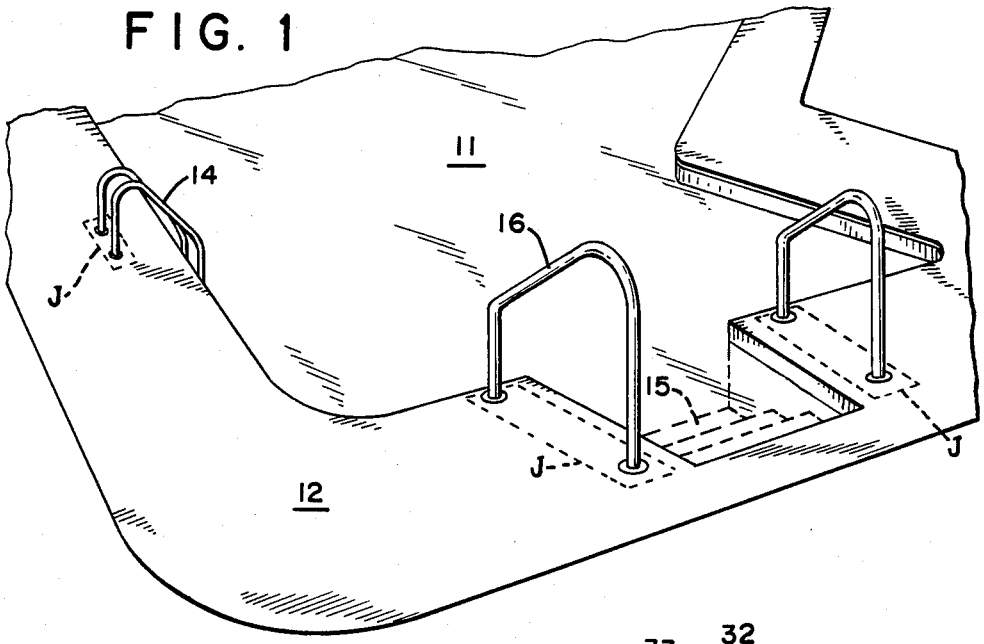
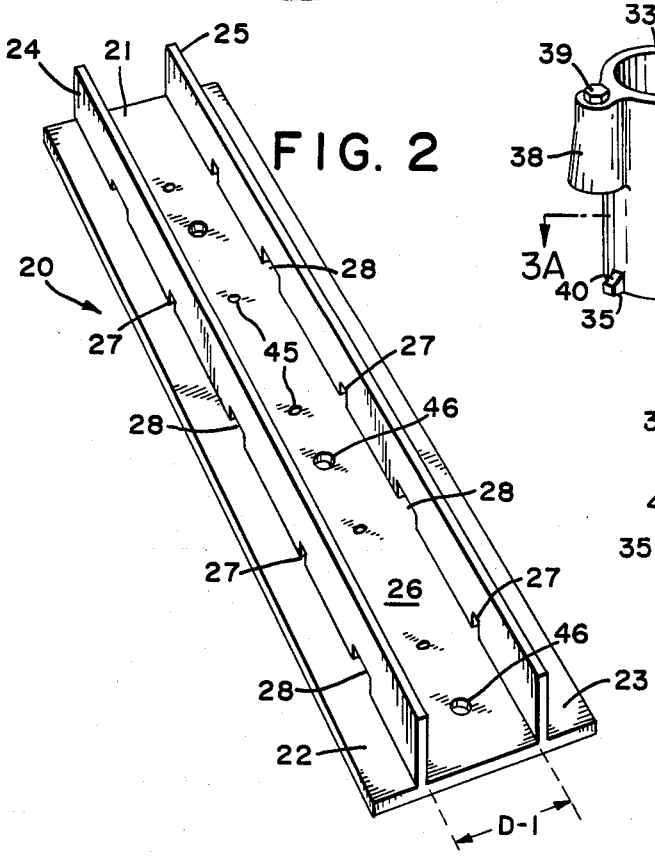
FIG. 2
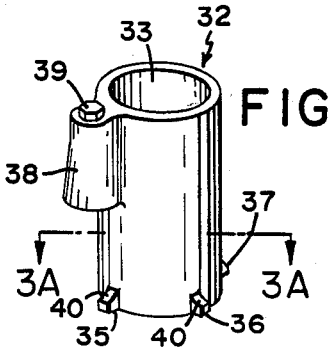
FIG. 3
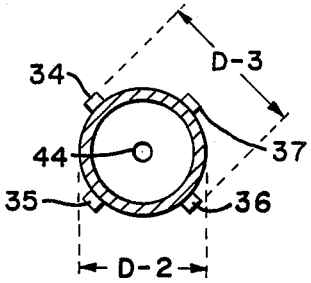
FIG. 3A

ANCHOR SOCKET JIG ASSEMBLY

This invention relates to a holding means which is disposed below ground level and which serves to securely anchor therein an implement for use above ground level. More particularly, the invention relates to an improved, relatively easily installed, anchoring means that is placed in location before concrete is poured and thereafter serves to hold therein, above ground, any suitable implement or device such as a step or ladder rail used in connection with a swimming pool.

BACKGROUND OF THE INVENTION

In the past, below ground jig assemblies used for positioning and securely holding elements on a concrete surface including in particular, but not limited to, hand rails, have comprised a first support member which is generally a longitudinal metal member that provides increased stability for the socket member which is attached to the longitudinal member, such as by welding or bolting. This jig assembly is positioned in a location on which a concrete structure is to be fabricated, such that when the concrete that is to form the structure is poured, the longitudinal member and the implement holding socket are embedded in the concrete with the top only of the socket in which a surface implement is to be held, exposed, substantially at the level of the concrete surface. The embedded assembly affords the means to insert and secure an implement such as a hand rail into the socket. Means such as an eccentric element is contained on the socket member to secure or lock the implement that is inserted in the socket.

In the past, the joinder of the socket member to longitudinal support member of the jig assembly, if preassembled, generally required that the socket member be welded or bolted which limits its versatility for different size implements. Also, when pre-assembled, the combined socket and longitudinal pieces presented a bulky package for shipping. On the other hand, when assembled at the site, prior to installation, the task is time consuming and the screws or bolts may be lost or not always securely attached.

Accordingly, a need exists for an improved device of the kind which facilitates the assembly of the socket and longitudinal support and which provides versatile spacing for different size implements and without the need for welding, bolting or other extraneous means for attaching the socket members on the rail member.

SUMMARY OF THE INVENTION

In accordance with the invention, an improved anchor socket and jig assembly for holding implements in concrete is provided which facilitates assembly of the socket element on the longitudinal base or rail support member of the jig assembly and which affords substantially expanded adaptability of the device for implements requiring various spacing and without the need for bolts, welding, or other extraneous means, to secure the socket member to the support member.

The improved jig assembly comprises a longitudinal base member of substantially rigid plastic composition which is provided with a plurality of paired side slots comprising a series of locator openings which fit one of the feet of the socket member and, cooperating therewith, a mating series of turn slots. Both the openings and the turn slots are formed to accommodate the feet of the socket member. The assembly of the socket in the base member in a secure position is readily effected by positioning the socket member between the rails of the base member and locking the two by a manual quarter turn rotation of the socket member in the base member. No tools or other assembly operation of any kind is needed. The socket member is formed so that feet at the opposite sides and at the base of the socket are spaced so that the distance to the extremities of opposite feet is greater than the distance between the rails of the longitudinal base member. The socket feet comprise a tapered shape that securely binds and retains the socket member in the slots formed in the plastic U-shaped base member.

BRIEF DESCRIPTION OF THE DRAWING

FIG. 1 is a fragmentary perspective view illustrating one utility of the invention in which the ends of hand rails for swimming pool steps and ladder are embedded in the concrete deck surrounding a swimming pool; the jig of the invention embedded in the concrete and outlined by the broken line in the concrete deck shown in FIG. 1 provides the securing means for the rails which are removably secured in the sockets of the jig.

FIG. 2 is a perspective view of the longitudinal base member of the jig assembly of the invention.

FIG. 3 is a perspective view of the socket member used with the base of FIG. 2 or 2A in the assembly of the invention.

FIG. 3A is a sectional view along line 3A—3A of FIG. 3.

DETAILED DESCRIPTION OF THE INVENTION

Figure 4:
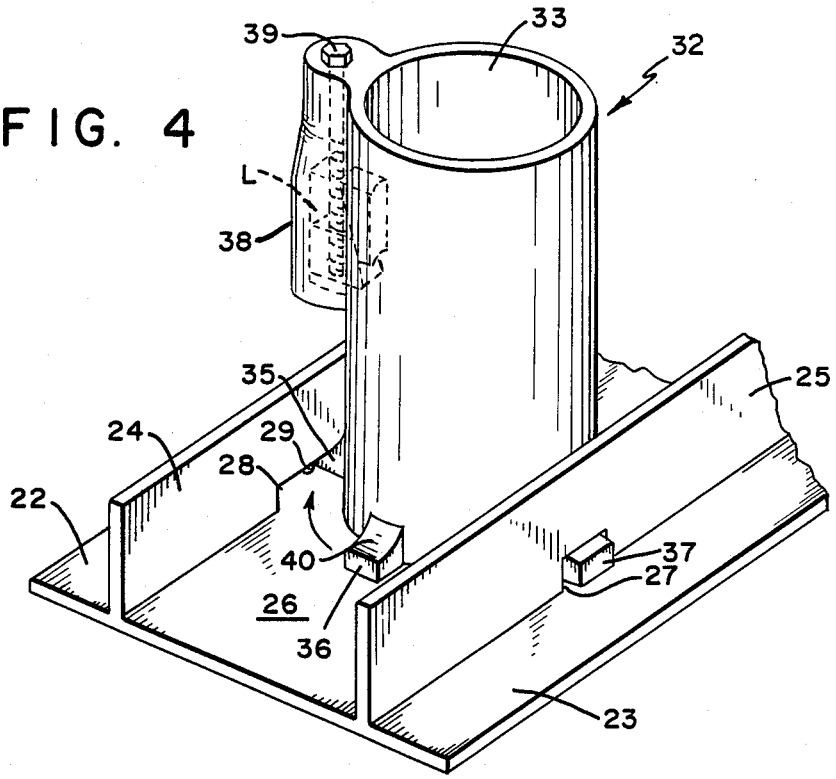
FIG. 4 is a perspective view of the socket member with the feet thereof secured in the openings at the bottom of the base member to provide the jig assembly of the invention.

In accordance with the invention an improved jig assembly is provided which facilitates the use of devices of this kind that are employed to hold implements such as a railing in a concrete structure. Implements of this kind, such as a railing, must be securely anchored to resist substantial forces.

The assembly of the invention comprises a rail member in which cooperating pairs of apertures are formed at the base of the rails in which the socket member feet are introduced and securely held.

Referring to the drawing, a fragmentary portion of a swimming pool 11 having a surrounding deck portion 12 and conventional ladder 14 and steps 15 with railing 16 is illustrated. The jig assembly of the invention is employed at any location where it is desired to attach an implement on a concrete structure and to provide a secure anchor (which is embedded in concrete) for the implement. The position of jig assembly of the invention which is employed as such anchoring means is indicated by broken line "J" at the base of the rail members 14 and 16 in FIG. 1. While the jig of the invention is illustrated in position in concrete so as to as to receive in the socket a vertically disposed rail member, it will be apparent that the jig assembly may also be positioned in concrete so as to insert in the socket member of the jig a horizontally disposed member of an implement such as, for example, a securing toggle on a vertical wall.

Figure 2A:
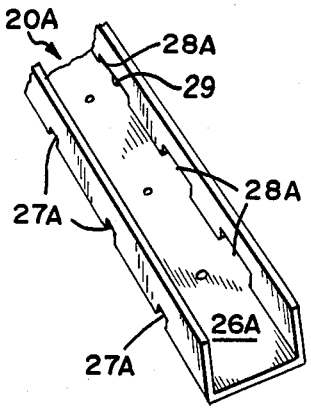
FIG. 2A is an alternative to the base member of FIG. 2.

As seen by reference to FIG. 2, the base member 20 of the jig assembly of the invention comprises a longitudinal member having a base portion 21 and a pair of spaced rails 24 and 25 thereon defining a central base portion 26. The socket member 32, hereinafter described in greater detail, is positioned on base portion 26 between the rails 24 and 25. The base member 20 may optionally be provided also with outboard segments 22 and 23 when desired, as for example, to provide supplementary securing means for the jig assembly when placed on location, prior to pouring concrete, and to avoid dislocation of the jig assembly by workmen at the worksite or by the weight of concrete on the jig assembly. It will be understood, however, that the base member may be formed without the outboard sections 22 and 23 in which case it comprises a longitudinal member which is generally U-shaped in cross-section formed by base 26 and side rails 24 and 25 as in FIG. 2A.

The base member is provided with a series of socket-foot size locating openings 27 of a size which fit a foot of the socket member, three of which 35, 36 and 37 are shown in FIG. 3 and a series of slots 28 opposite to, and generally cooperating with, the openings 27 to hold opposite feet of the socket member 32. The openings 27 and slots 28 are spaced at suitable incremental distances at the base of the rail portions 24 and 25 to accommodate implements having distances of various sizes such as the spaced ladder rails of FIG. 1. While the openings 27 may be formed all on one rail and the slots 28 all on the other rail, as in FIG. 2A, it is preferred that openings 27 and slots 28 both be alternated on each of the rails 24 and 25.

The base member 20 is formed from suitable plastic composition such as polyvinyl chloride or other plastic material such as polyethylene, polypropylene, polycarbonate, nylon, and the like, which is sufficiently rigid and has suitable impact resistance. The thickness of the plastic material for the member 24, particularly that of the rail portions 24 and 25 is sufficiently substantial, e.g. of the order of ⅛" thickness or greater, to prevent significant distortion and provide an adequate locking hold on the socket member 32 secured therein.

Referring to FIG. 3, the socket member 32 comprises a generally hollow cylindrical element which has an opening 33 at the top and a plurality of feet usually four in number, which are equally spaced at 90 degree intervals at the base of socket member 32, three of said feet 35, 36 and 37 being illustrated in FIG. 3. Member 32 is provided also with an implement locking device 38 to hold an implement such as a rail inserted in the opening 33. The locking device comprises a suitable wedge element of a known kind which, upon tightening the screw of bolt 39, raises a floating locking piece L with threaded attachment to bolt 39 in the well of the device 38, that binds with increasing force against the implement 14 as the bolt 39 is tightened.

The socket member 32 is formed of a suitable material preferably a cast metal, but may comprise also a suitable plastic material of appropriate thickness and rigidity such as polycarbonate.

The locking feet 34, 35, 36 and 37 formed at the base of the socket member 32 as shown by reference to FIG. 3A extend from the cylindrical body so that the distance D-2 between the extremities of adjacent feet does not exceed the distance D-1 between the rail member 24 and 25 of the base member 20. The feet 34, 35, 36 and 37 are formed so as to have a tapered or "ankle" transitional part 40 such that when the socket member 32 is positioned and bottomed in the space 26 between the rails 24 and 25, i.e. with the feet 34, 35, 36 and 37 of the socket 32 between the rails 24 and 25 of the member 20, with one of said feet in an opening 27, and the socket member 32 is rotated 90 degrees, the socket 32 is securely locked in the base member 20. This is due to the fact that the distance D-3 (FIG. 3A) between the extremities of a pair of opposite feet substantially exceeds the distance D-1; and upon rotation of the socket member 32 the opposite feet are wedged in opening 27 and slot 28. The tapered or ankle portion 40 of the respective feet 34, 35, 36 and 37 serves to increasingly bind against the top of opening 27 and the top of slot 28 as the socket completes the 90 degree rotation. The plastic material, while yielding to accommodate the ankle portion 40, serves to provide a substantial lock on the socket member, precluding separation unless a substantial reverse rotational force is applied to the socket member. As an auxiliary locking device, the slot 28 may be provided with a protrusion 29 at the top of slot 28 which the ankle portion 40 overrides as the socket 32 is being rotated in place, to preclude the possibility of inadvertent dislocation (i.e. reverse rotation) of socket member 32 from a secure lock in base 20.

To permit drainage of water which may accumulate in the socket member 32, an opening 44 is provided at the bottom of the socket member 32. A corresponding opening 45, in alignment with the socket member drainage opening 44 is provided in the portion 26 of the base member 20 to allow free passage therethrough of water that may tend to accumulate in the socket member 32. The base member 20 may also be provided with reinforcing rod (rerod) securing openings 46 at suitably spaced locations in the central portion 26 of base member 20.

The relationship of the socket member 32 locked on the base member 20 is best illustrated in FIG. 4. As seen therein, when the socket member 32 is positioned on the central portion 26 of base member 20 and is rotated as shown by the arrow in FIG. 4, the foot 37 enters the opening 27 and foot 35, because of the tolerance permitted by the longitudinal slot 28, traverses the slot 28 from unlocked to locked position, left to right, as shown in FIG. 4 as the socket is rotated in the direction of the arrow. The effect of thus rotating the member 32 in the base member 20 is to effectively utilize the structural distance D-3 extending between the extremities of feet 35 and 37 to hold member 32 in the rails 24 and 25 which are spaced a substantially lesser distance D-1, with ankle portions 40 of the feet wedging against the top of the opening 27 and the slot 28, respectively. A noted hereinabove, a protrustion 29 formed at the top of the slot member 28 sufficiently spaced from the end of the slot 28 to provide a supplementary holding means, abutting against the foot 35 when the socket 32 is in the locked position, to preclude counter-rotation of the socket member 32.

Figure 5:
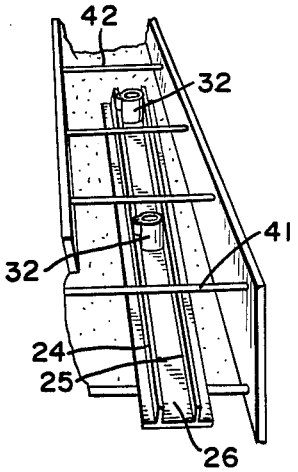
FIG. 5 illustrates the jig assembly of the invention positioned in a region of a ground excavation preparatory to pouring concrete which embeds the assembly therein.

As shown in FIG. 5, the assembled jig, comprising the base member 20 and socket member 32, is illustrated in position in an excavation, being retained against movement by suitable securing braces 41 and 42, preparatory to pouring of concrete and embedding the assembly such that the top of the socket member 32 is essentially flush with the contiguous concrete surface.

When the concrete has set, an implement with a securing portion, such as a ladder runner, of a dimension which conforms to the inside of socket 32 is introduced into the opening 33 and is secured in place by rotating the screw 39 in the socket locking adapter 38 raising the locking element L which binds or seizes the portion of the securing element which has been inserted into the socket opening 33.

While the invention has been described in detail to illustrate the preferred embodiment of the invention, it will be understood that the invention is not limited to such details except as set forth in the appended claims.

What is claimed is:

1. A jig and socket assembly for embedding in concrete and which serves to hold an implement that is inserted and secured in the socket of the assembly comprising:

(a) a longitudinal base member having a base portion, a first rail portion and a second rail portion, each of said portions extending longitudinally, said first and second rail portions being in spaced relation, and being integrally formed with said base portion and being disposed at a substantially right angle from said base portion, a first foot locating opening in said first rail and a second, longitudinal, opening in said second rail located opposite said first opening, said first and second openings being formed contiguous to the base portion, and (b) a substantially cylindrical socket member adapted to be securely locked on said base member, said socket member having a diameter substantially equal to the distance between said first and second rail portions, an implement securing opening at the top of the cylindrical socket, and at least one pair of securing feet extending substantially in diametrically opposite direction at a base portion of said socket member, said socket member adapted to be disposed with the feet on the said base portion and such that one of the feet of said pair interlock in said foot locating opening in one rail and the second foot of said pair rides in and is interlocked in said longitudinal opening in said second rail as the socket member is rotated substantially 90 degrees relative to the base member.

2. The assembly of claim 1 in which the base portion has a plurality of foot locating openings and a plurality of second longitudinal openings.

3. The assembly of claim 1 wherein the foot locating openings alternate with second longitudinal openings in each of the first and second rails.

4. The assembly of claim 1 wherein the cylindrical socket member is provided with a locking means to grip an implement inserted in the socket implement securing opening.

5. The assembly of claim 1 wherein the longitudinal base portion comprises a substantially rigid plastic composition.

6. The assembly of claim 5 wherein the socket member comprises a metal member.

7. The assembly of claim 5 wherein the socket member comprises a substantially rigid plastic composition.

8. The assembly of claim 1 wherein the base member is provided with outboard segments contiguous to each rail portion.

9. The assembly of claim 1 wherein the second opening is provided with a locking protrusion affording resistance to movement in said opening of the one of said feet of the socket member that is inserted in said second opening.

10. The assembly of claim 1 wherein a hand rail is positioned in said implement securing opening of the socket member.

* * * * *